US007228838B2

(12) United States Patent
Aoyama et al.

(10) Patent No.: US 7,228,838 B2
(45) Date of Patent: Jun. 12, 2007

(54) INTERNAL COMBUSTION ENGINE

(75) Inventors: Shunichi Aoyama, Kanagawa (JP); Katsuya Moteki, Tokyo (JP); Shinichi Takemura, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 11/313,683

(22) Filed: Dec. 22, 2005

(65) Prior Publication Data

US 2006/0137632 A1 Jun. 29, 2006

(30) Foreign Application Priority Data

Dec. 24, 2004 (JP) ..... 2004-372466

(51) Int. Cl.
*F02B 75/32* (2006.01)

(52) U.S. Cl. ..... 123/197.4; 123/48 B; 123/78 E

(58) Field of Classification Search ..... 123/197.4, 123/48 R, 48 B, 78 R, 78 BA, 78 E, 78 F
See application file for complete search history.

(56) References Cited

U.S. PATENT DOCUMENTS 4,517,931 A 5/1985 Nelson
5,732,673 A * 3/1998 Mandella ..... 123/197.4
6,390,035 B2 5/2002 Moteki et al.

FOREIGN PATENT DOCUMENTS

| | | | |
|---|---|---|---|
| EP | 1 178 194 | A2 | 2/2002 |
| EP | 1 347 159 | A2 | 9/2003 |
| JP | 2001-227367 | A | 8/2001 |
| JP | 2003/013764 | A | 1/2003 |
| JP | 2005-171857 | A | 6/2005 |

* cited by examiner

*Primary Examiner*—Noah P. Kamen
(74) *Attorney, Agent, or Firm*—Foley & Lardner LLP

(57) ABSTRACT

An internal combustion engine includes a piston reciprocating in a cylinder; a crankshaft; and a multilink piston-crank mechanism linking the piston with the crankshaft. The multilink piston-crank mechanism includes an upper link having a first end connected with the piston by a piston pin; a lower link mounted rotatably on a crankpin of the crankshaft and having a first end connected with a second end of the upper link by a first connection pin; a control link having a first end connected with a second end of the lower link by a second connection pin; a control shaft connected movably with a second end of the control link and configured to rotate in synchronization with the crankshaft and at a half rotational speed of the crankshaft; and a phase adjusting section configured to variably adjust a phase of rotation of the control shaft relative to the crankshaft in accordance with an operating condition of the engine. The multilink piston-crank mechanism is configured to variably control a piston stroke characteristic of the engine.

7 Claims, 7 Drawing Sheets

INTERNAL COMBUSTION ENGINE

BACKGROUND OF THE INVENTION

The present invention generally relates to an internal combustion engine having a multilink-type piston crank mechanism for reciprocating a piston.

Japanese Patent Application Publication No. 2001-227367 discloses a variable compression ratio mechanism of an internal combustion engine using a multilink piston crank mechanism, which was previously proposed by the assignee of the present application. This mechanism links a piston and a crankpin with each other by an upper link and a lower link. One end of the upper link is connected with the piston via a piston pin. The other end of the upper link is connected with the lower link via a first connection pin. The lower link is mounted rotatably on the crankpin of a crankshaft. Moreover, this mechanism restrains movement of the lower link by a control link having one end connected with the lower link via a second connection pin. The other end of the control link is supported on a lower part of a cylinder block via a cam mechanism. The center of swinging motion of the other end of the control link can be shifted by the cam mechanism so as to vary a top dead center of the piston.

SUMMARY OF THE INVENTION

It is an object of the present invention to provide an internal combustion engine having the piston connected with the crankshaft by a multilink-type piston crank mechanism, and devised to optimize a piston stroke characteristic to improve a fuel economy and/or an output power.

According to one aspect of the present invention, there is provided an internal combustion engine, comprising: a piston reciprocating in a cylinder; a crankshaft; and a multilink piston-crank mechanism linking the piston with the crankshaft and including; an upper link having a first end connected with the piston by a piston pin; a lower link mounted rotatably on a crankpin of the crankshaft and having a first end connected with a second end of the upper link by a first connection pin; a control link having a first end connected with a second end of the lower link by a second connection pin; a control shaft connected movably with a second end of the control link and configured to rotate in synchronization with the crankshaft and at a half rotational speed of the crankshaft; and a phase adjusting section configured to variably adjust a phase of rotation of the control shaft relative to the crankshaft in accordance with an operating condition of the engine, the multilink piston-crank mechanism being configured to variably control a piston stroke characteristic of the engine.

According to another aspect of the present invention, there is provided an internal combustion engine, comprising: a piston reciprocating in a cylinder; a crankshaft; and piston-crank linking means for linking the piston with the crankshaft and including; upper linking means having a first end connected with the piston; lower linking means mounted rotatably on a crankpin of the crankshaft and having a first end connected with a second end of the upper linking means; control linking means having a first end connected with a second end of the lower linking means; a control shaft connected movably with a second end of the control linking means and configured to rotate in synchronization with the crankshaft and at a half rotational speed of the crankshaft; and phase adjusting means for variably adjusting a phase of rotation of the control shaft relative to the crankshaft in accordance with an operating condition of the engine, the piston-crank linking means being configured to variably control a piston stroke characteristic of the engine.

The other objects and features of this invention will become understood from the following description with reference to the accompanying drawings.

DETAILED DESCRIPTION OF THE INVENTION

Reference will hereinafter be made to the drawings in order to facilitate a better understanding of the present invention.

Figure 1:
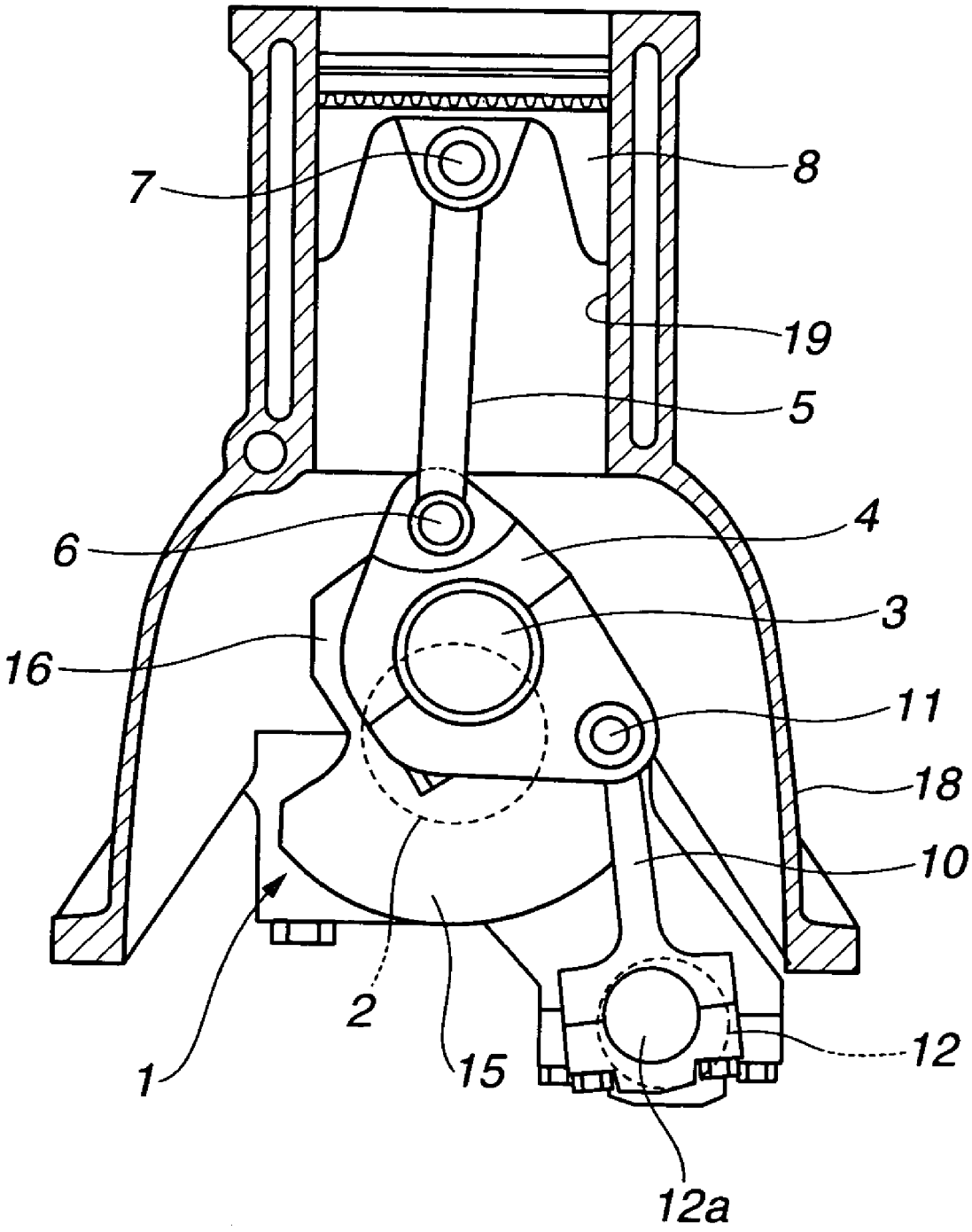
FIG. 1 is a vertical sectional view showing a schematic configuration of a multilink-type piston crank mechanism in an internal combustion engine according to an embodiment of the present invention.

FIG. 1 is a vertical sectional view showing a schematic configuration of a variable compression ratio mechanism using a multilink-type piston crank mechanism in an internal combustion engine according to an embodiment of the present invention. The internal combustion engine of this example is a four-cycle direct-cylinder-injection gasoline engine. The variable compression ratio mechanism is composed of the multilink-type piston crank mechanism or piston-crank linking mechanism (or linkage) mainly including a lower link 4, an upper link 5, a control link 10, a control shaft 12, and a phase control mechanism (or, phase adjusting section) 31.

The internal combustion engine of FIG. 1 includes a crankshaft 1, and a cylinder block 18 housing cylinders 19, and also includes the multilink piston crank mechanism and a piston 8 for each of cylinders 19. Crankshaft 1 includes a journal portion 2 and a crankpin 3 for each cylinder. Journal portion 2 is supported rotatably on a main bearing of cylinder block 18. Crankpin 3 is eccentric from journal portion 2 by a predetermined distance. Lower link 4 is rotatably connected with (i.e., is rotatably mounted on) crankpin 3. Crankshaft 1 also includes counterweights 15 and crank webs 16. Each of crank webs 16 connects journal portion 2 with crankpin 3. Each of counterweights 15 extends from crank web 16 in a direction away from crankpin 3, and includes a circumferential portion formed in an arc-shape around journal portion 2. Respective two of counterweights 15 are installed to oppose each other across crankpin 3 in an axial direction of crankpin 3. Piston 8 reciprocates in cylinder 19 inside cylinder block 18 by combustion pressure.

Lower link 4 is divisible into right and left members, and includes a connection hole surrounded by the right and left portions and located substantially in a midsection of lower link 4. Crankpin 3 is fit in the connection hole.

Upper link 5 includes a lower end rotatably connected with one end of lower link 4 by a first connection pin 6, and an upper end rotatably connected with piston 8 by a piston pin 7.

The internal combustion engine of FIG. 1 also includes control shaft 12. Control link 10 includes an upper end rotatably connected with the other end of lower link 4 by a second connection pin 11, and a lower end rotatably connected with a lower part of cylinder block 18 through control shaft 12. Control shaft 12 is connected movably and rotatably with the lower end of control link 10. Control link 10 thereby restrains movement of lower link 4. The lower part of cylinder block 18 forms a part of the engine body. Control shaft 12 is rotatably supported on the engine body, and includes an eccentric cam (section) 12*a* which is eccentric from an axis of rotation of control shaft 12. The lower end of control link 10 is rotatably fit over eccentric cam 12*a*.

Figure 2:
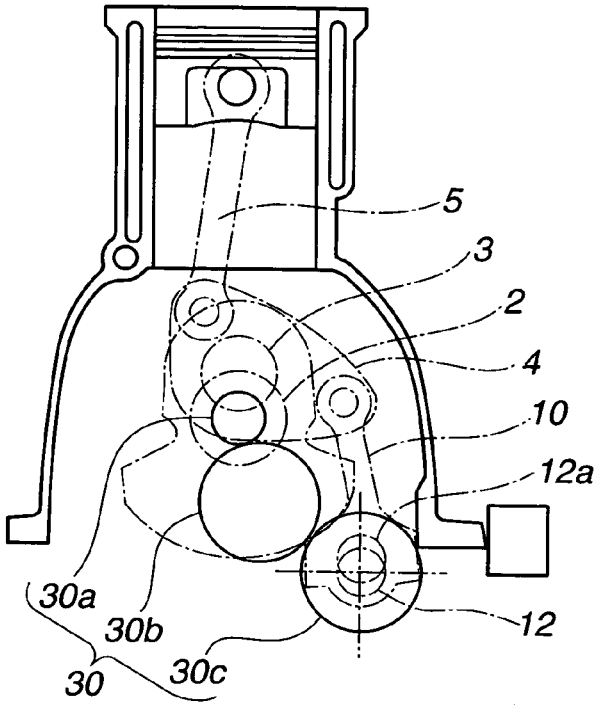
FIG. 2 is a sectional view showing a schematic configuration of a gear train transmitting the rotation of a crank shaft to a control shaft, according to the embodiment.
Figure 3:
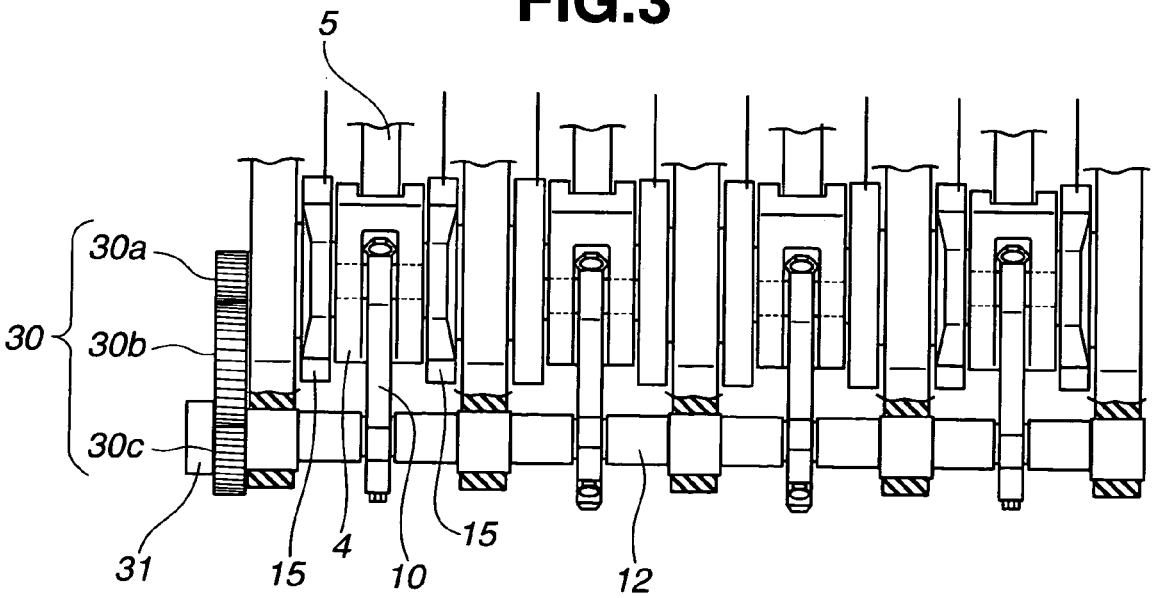
FIG. 3 is an explanatory view showing the schematic configuration of the gear train transmitting the rotation of the crank shaft to the control shaft, according to the embodiment.
Figure 4:
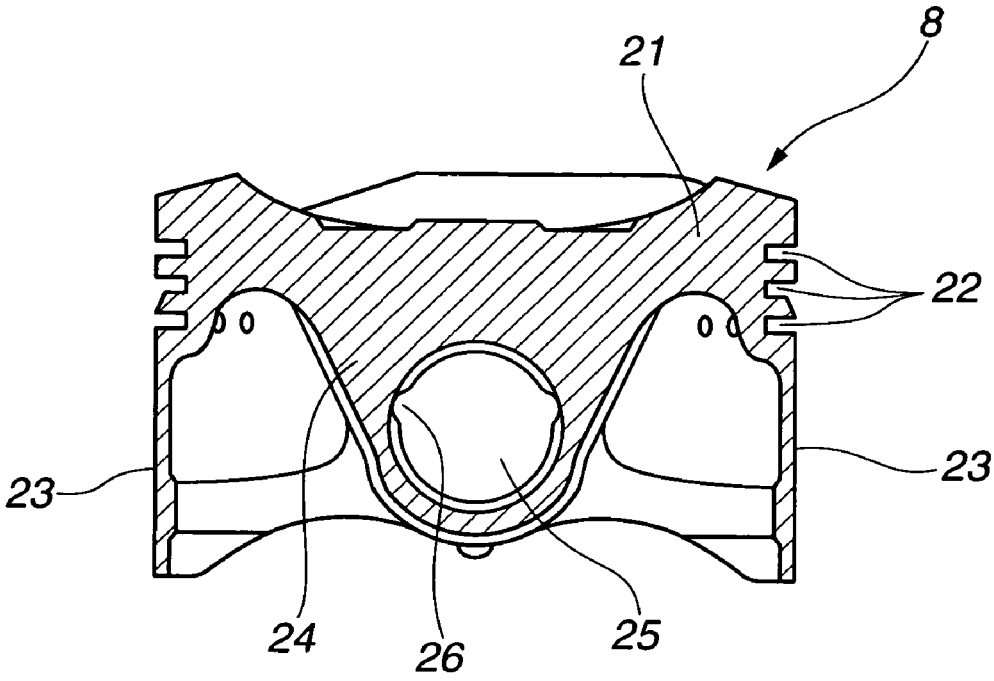
FIG. 4 is a vertical sectional view of a piston as taken along a plane orthogonal to an axis of the crank shaft.
Figure 5:
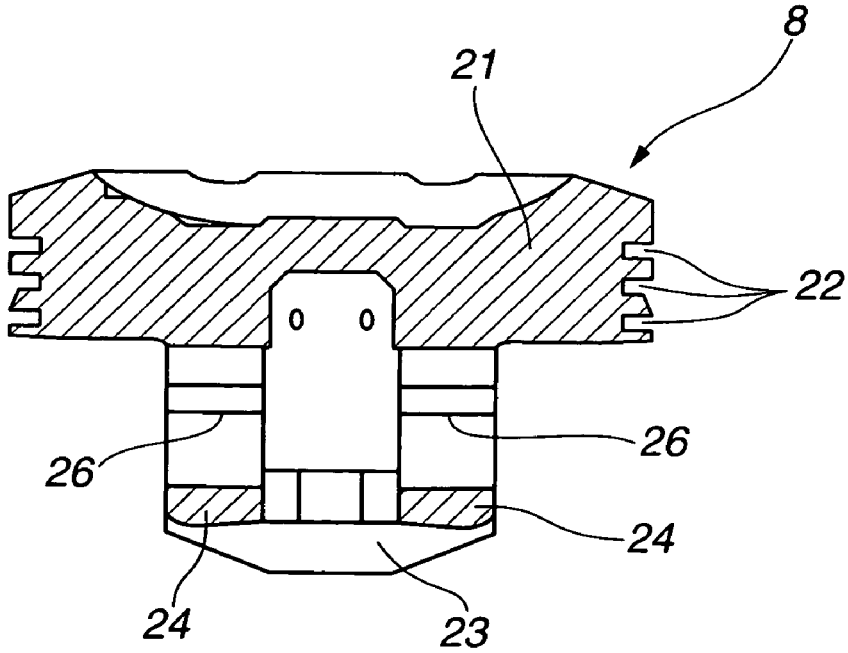
FIG. 5 is a sectional view of the piston as taken along a plane parallel to the axis of the crank shaft.
Figure 6:
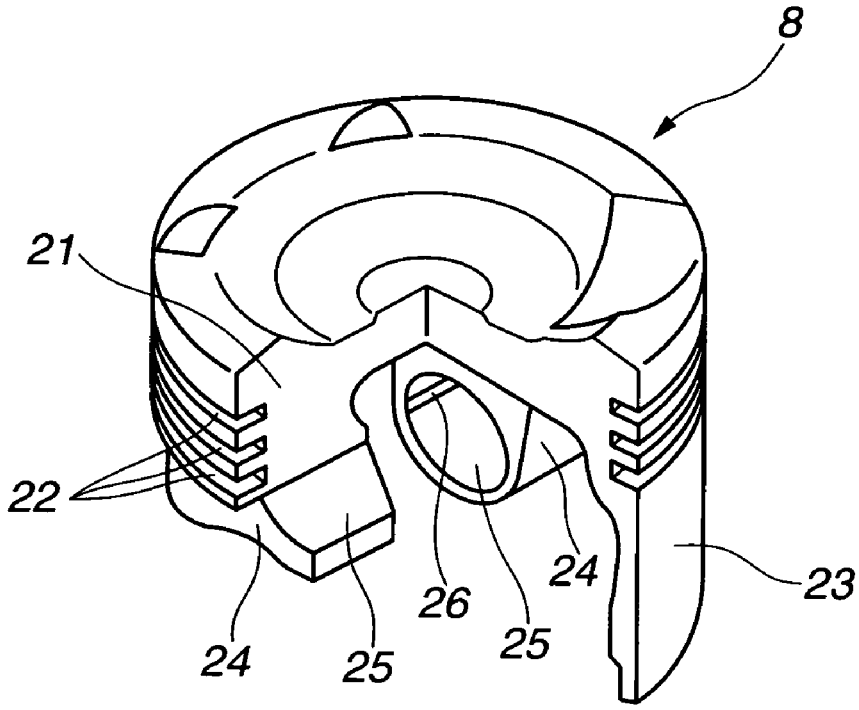
FIG. 6 is a perspective cutaway view showing the piston according to the embodiment.

As shown in FIG. 2 and FIG. 3, rotation of crankshaft 1 is transmitted through a first gear 30*a*, a second gear 30*b*, and a third gear 30*c* to control shaft 12. A gear train 30 composed of first gear 30*a*, second gear 30*b* and third gear 30*c* is designed (is set) so that control shaft 12 rotates at a half rotational speed of crankshaft 1. Namely, control shaft 12 rotates in synchronization with crankshaft 1 at a half rotational speed as compared to that of crankshaft 1.

Control shaft 12 is controlled by phase control mechanism (or, phase adjusting section) 31 operating in accordance with a control signal from an engine control unit. More specifically, a phase of rotation of control shaft 12 relative to crankshaft 1 is controlled or adjusted variably in accordance with an operating condition (or driving condition) of the engine by phase control mechanism 31.

When control shaft 12 is rotated by phase control mechanism 31, the central position of eccentric cam 12*a* varies relative to the engine body. This varies the position of the lower end of control link 10 relative to control shaft 12 (or, relative to the engine body), which is supported movably relative to the engine body by eccentric cam 12*a* and control shaft 12. The variation of the support position of control link 10 varies a movement of piston 8. In the above-described variable compression ratio mechanism using the multilink piston crank mechanism linking piston 8 with crankshaft 1, control shaft 12 linked to control link 10 by eccentric cam 12*a* rotates in synchronization with crankshaft 1 and at the half rotational speed of crankshaft 1. Hence, the position of an exhaust top dead center of piston 8 (i.e., vertical position of piston 8 at an exhaust top dead center) can be varied to be different from that of a compression top dead center of piston 8. In other words, two different positions of piston top dead center can be changed alternately in the four-cycle engine. Moreover, when the rotational phase of control shaft 12 relative to crankshaft 1 is varied (at some point of crank angle) by phase control mechanism 31, a stroke characteristic of piston 8 is varied, namely the vertical positions of piston 8 at the compression top dead center (compression TDC) and at the exhaust top dead center (exhaust TDC) are respectively varied. Concretely, phase control mechanism (or phase adjusting section) 31 varies the phase of rotation of control shaft 12 relative to crankshaft 1 by moving the position of the lower end of control link 10 relative to control shaft 12 at some point of crank angle (i.e., with crank angle kept constant). Thus, the variable compression ratio mechanism can vary a compression ratio of the engine.

Next, the configuration of piston 8 and upper link 5 will now be explained in detail with reference to FIGS. 4 to 7.

Figure 7:
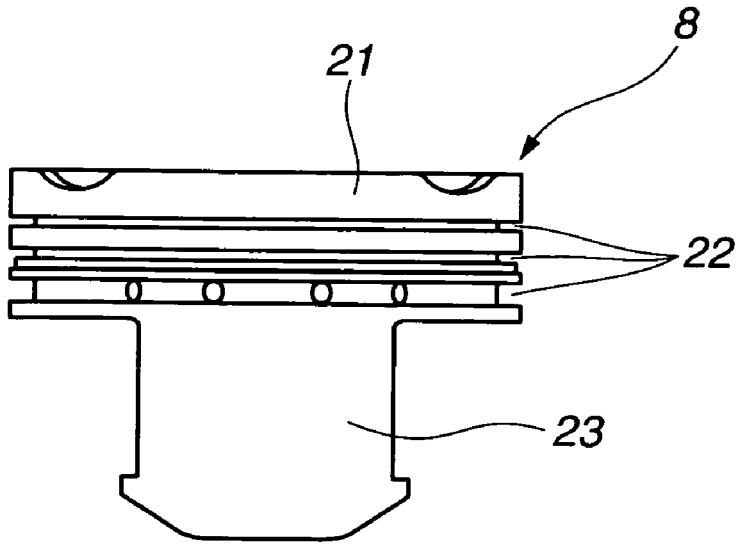
FIG. 7 is a side view of the piston according to the embodiment.

Piston 8 of this example is cast integrally by using an aluminum alloy, and includes a piston crown or piston head portion 21, piston-ring groove portion 22, and first and second skirt portions 23. Piston head portion 21 has a relatively thick circular form including a circumferential portion (surface) formed around a circumferential direction of piston 8. Namely, piston head portion 21 is shaped like a disc. Piston-ring groove portion 22 is formed in the circumferential portion of piston head portion 21 in the circumferential direction. In this example, piston 8 includes three piston-ring grooves 22. First and second skirt portions 23 are formed, respectively, on thrust and counterthrust sides of the circumferential direction of piston 8 (i.e., are formed in a thrust-counterthrust direction of piston 8), and extend from the circumferential portion of piston head portion 21 downwardly along an inner circumference of cylinder 19. A projected shape of each of skirt portions 23, as viewed from a direction orthogonal to the axis of piston pin 7, is substantially rectangular, as shown in FIG. 7. As shown in FIG. 7, each of skirt portions 23 has a width substantially equal to or shorter than an overall length of piston pin 7, as compared in a direction parallel to the axis of piston pin 7. That is, each of skirt portions 23 is provided in a considerably small range in the circumferential direction.

Piston 8 also includes a pair of pin boss portions 24 formed at a center part of piston 8 and spaced from each other. Each of pin boss portions 24 protrudes at a center part of the underside of piston head portion 21, and includes a pin hole 25 extending through pin boss portion 24 in the axial direction of piston pin 7. Namely, pin hole 25 is so formed as to penetrate pin boss portion 24. Ends of piston pin 7 are fit rotatably in pin holes 25. Each of pin holes 25 includes a pair of oil grooves 26 formed in an inside surface of pin hole 25 and extending in the axial direction of piston pin 7.

Figure 8:
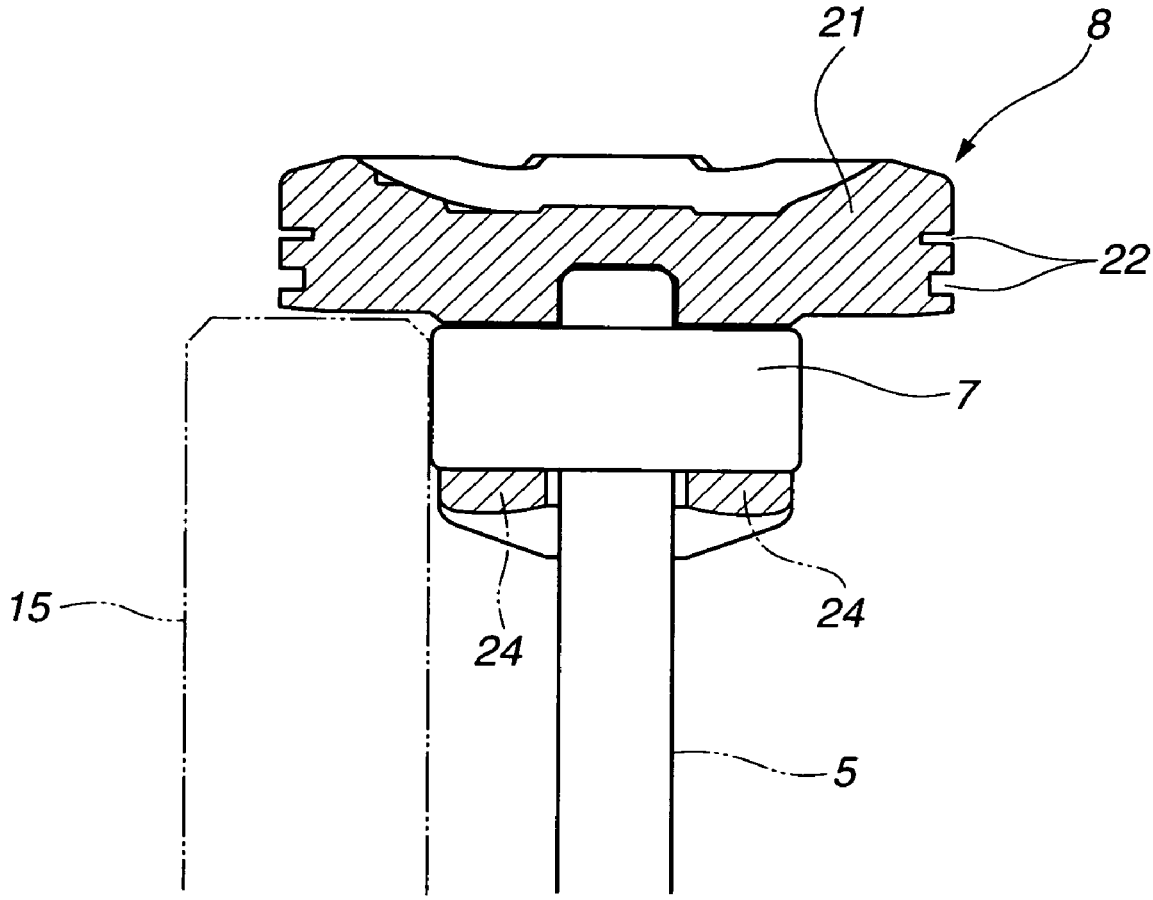
FIG. 8 is an explanatory sectional view showing a positional relationship between the piston at a bottom dead center and a counterweight used in the internal combustion engine according to the embodiment.

FIG. 8 is a side sectional view showing upper link 5, counterweight 15 and piston 8 at a bottom dead center. Upper link 5 of this example is made of steel. The upper end of upper link 5 extends through a gap between pin boss portions 24. Piston pin 7 is press-fitted into the upper end of upper link 5 at the gap, and thereby connects the upper end of upper link 5 with piston 8, as shown in FIG. 8.

At the upper and lower ends of upper link 5, piston pin 7 and first connection pin 6 have a substantially equal axial length to each other. Besides, piston pin 7 and first connection pin 6 basically receive an equal load. Hence, piston pin 7 and first connection pin 6 can be designed to have an equal diameter or sectional size.

Pin boss portions 24 and piston pin 7 form a piston connection structure for connecting piston 8 with upper link 5. A size of the piston connection structure, as measured in the axial direction of piston pin 7, is considerably smaller than a diameter of each of piston 8 and cylinder 19, as shown in FIG. 8.

When piston 8 is located in the proximity of the bottom dead center, an (radially) outermost portion of counterweight 15 crosses an imaginary extension line extended from piston pin 7 in the axial direction, as shown in FIG. 8. In other words, when piston 8 is located in the proximity of the bottom dead center, the outermost portion of counterweight 15 passes on the lateral side of pin boss portion 24 and piston pin 7 without conflicting with pin boss portion 24 and piston pin 7.

Piston 8 of this embodiment includes the small skirt portions 23 as mentioned above. Therefore, when counterweight 15 passes on the side of pin boss portion 24, counterweight 15 does not conflict with skirt portions 23. It is difficult that such a downsized skirt portion 23 has a large degree of strength or rigidity. However, the multilink piston crank mechanism explained in this embodiment undergoes a smaller amount of side thrust load acting to tilt piston 8 than a general single-link piston crank mechanism. Hence, skirt portions 23 can be formed with a minimum size.

As an advantage of the multilink piston crank mechanism, when the multilink piston crank mechanism provides the piston stroke characteristic approximate to simple harmonic motion (or oscillation), a piston acceleration of piston 8 is leveled, and the maximum inertial force is greatly reduced in the proximity of the piston top dead center. Therefore, pin boss portion 24 receiving piston pin 7 can be made smaller as mentioned above.

In this embodiment according to the present invention, the piston stroke (amount) in a four-cycle internal combustion engine including such a multilink-type piston crank mechanism is optimized mainly during an intake stroke.

Figure 9:
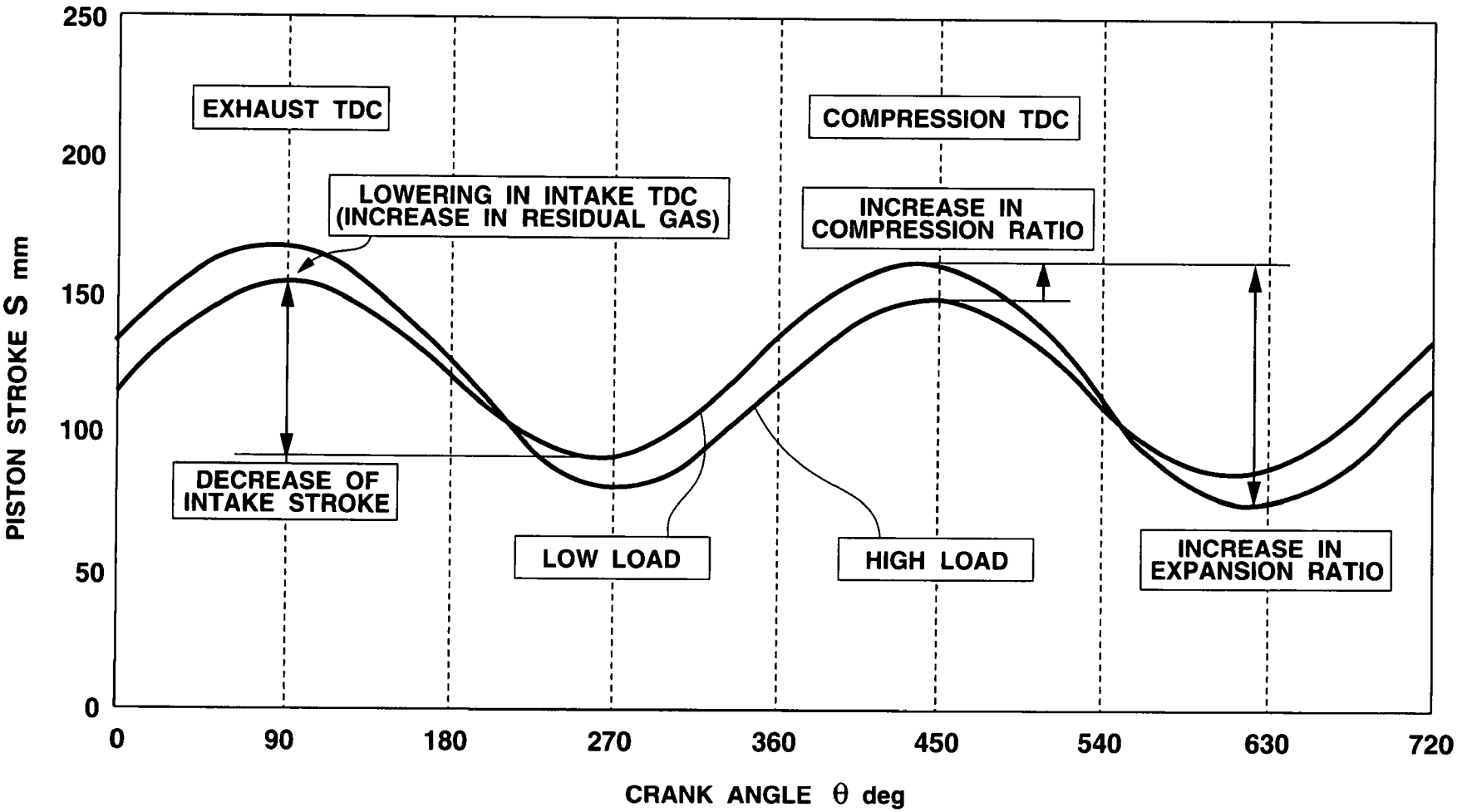
FIG. 9 is an explanatory schematic view showing an optimized piston stroke characteristic according to the embodiment.

FIG. 9 is an explanatory schematic view showing the optimized piston stroke characteristic. In this embodiment, (the vertical position of) the exhaust top dead center of piston 8 under a low engine load condition is set at a lower position than that under a high engine load condition as shown in FIG. 9, and thereby a combustion-chamber volume at the exhaust top dead center is relatively increased. Moreover under the low engine load condition, a vertical distance (or length) of the piston stroke of piston 8 during the intake stroke is shortened as compared to that under the high engine load condition. The compression top dead center of piston 8 under the low engine load condition is set at a higher position than that under the high engine load condition as shown in FIG. 9. Thereby the compression ratio of the engine at the compression top dead center is relatively increased, and (a distance of) the piston stroke of piston 8 during an expansion stroke is lengthened as compared to that under the high engine load condition. Under the low engine load condition, the vertical position of piston 8 at the exhaust top dead center differs from the vertical position of piston 8 at the compression top dead center.

On the other hand, (the vertical position of) the exhaust top dead center of piston 8 under the high engine load condition is set at a higher position than that under the low engine load condition as shown in FIG. 9, and thereby the combustion-chamber volume at the exhaust top dead center is relatively decreased. Moreover under the high engine load condition, (the distance of) the piston stroke of piston 8 during the intake stroke is lengthened as compared to that under the low engine load condition. The compression top dead center of piston 8 under the high engine load condition is set at a lower position than that under the low engine load condition as shown in FIG. 9. Thereby the engine compression ratio at the compression top dead center is relatively decreased, and (the distance of) the piston stroke of piston 8 during the expansion stroke is shortened as compared to that under the low engine load condition. Moreover, the combustion-chamber volume at the exhaust top dead center under the high engine load condition is set to be smaller than the combustion-chamber volume at the compression top dead center under the low engine load condition. In other words, in the case (of engine load condition) where the piston stroke (distance) of piston 8 during the intake stroke has the maximum value, the combustion-chamber volume at the exhaust top dead center of piston 8 has the minimum value. In addition, under the high engine load condition, the vertical position of piston 8 at the exhaust top dead center differs from the vertical position of piston 8 at the compression top dead center.

Namely, the multilink piston-crank mechanism is configured to vary the piston stroke characteristic; to allow the compression ratio of the engine in the case where the distance of piston stroke of piston 8 during the intake stroke is relatively short, to be higher than the compression ratio in the case where the distance of piston stroke of piston 8 during the intake stroke is relatively long. In other words, the piston stroke characteristic is varied; to allow the distance of piston stroke of piston 8 during the intake stroke in the case where the compression ratio of the engine is relatively high, to be shorter than the distance of piston stroke during the intake stroke in the case where the compression ratio of the engine is relatively low. Moreover, the multilink piston-crank mechanism is configured to vary the piston stroke characteristic to allow the distance of piston stroke of piston 8 during the expansion stroke to become longer as the distance of piston stroke of piston 8 during the intake stroke becomes shorter. Furthermore, the multilink piston-crank mechanism is configured to vary the piston stroke characteristic to allow the distance of piston stroke of piston 8 during the intake stroke to be shorter when the operating condition of the engine is under the low load condition, as compared to the distance in the case where the operating condition of the engine is under the high load condition.

Figure 10:
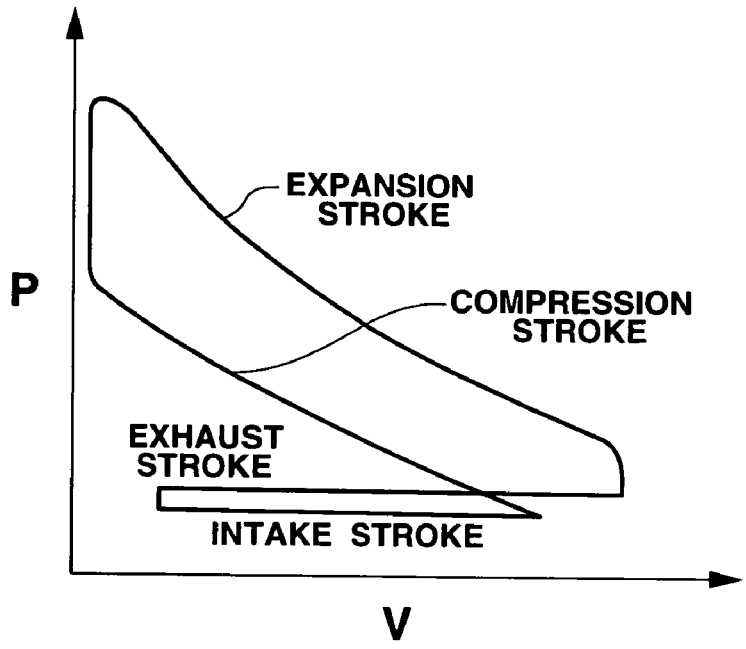
FIG. 10 is a pressure-volume diagram under a low-load engine condition, according to the embodiment.

Therefore, under the low engine load condition, an engine displacement is decreased by shortening the distance of piston stroke during the intake stroke, and a pumping loss can be reduced, as shown in FIG. 10. Moreover under the low engine load condition, a substantial effect of internal EGR (i.e., exhaust gas recirculation) can be obtained by increasing the combustion-chamber volume at the exhaust top dead center. Further, a combustion can be improved by increasing the compression ratio of the engine. Furthermore, an expansion work is increased and thereby the fuel economy can be improved since the length (distance) of piston stroke of piston 8 during the expansion stroke is relatively long.

Figure 11:
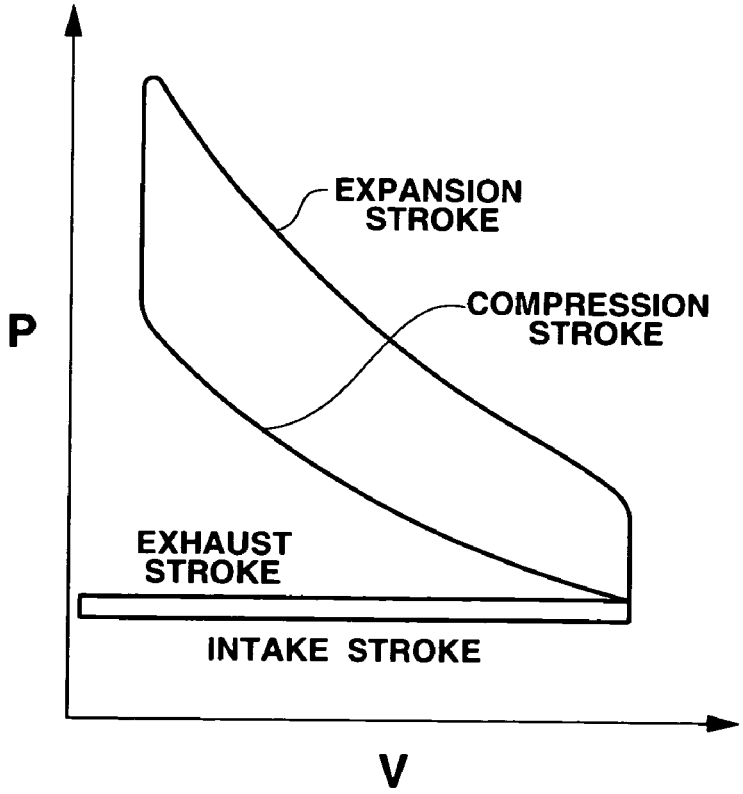
FIG. 11 is a pressure-volume diagram under a high-load engine condition, according to the embodiment.

Next, under the high engine load condition, output power and torque can be increased by lengthening the distance of piston stroke during the intake stroke, as shown in FIG. 11. Moreover, under the high engine load condition, a residual gas is reduced by decreasing the combustion-chamber volume at the exhaust top dead center, and thereby output power and torque can be increased. Furthermore, a knocking can be avoided by reducing the compression ratio of the engine.

It is noted that the compression ratio of the engine is a ratio between the combustion-chamber volume at the compression top dead center of piston 8 (namely, a gap volume remaining in cylinder 19) and the volume in cylinder 19 at the intake bottom dead center of piston 8. Especially, the compression ratio greatly depends on (i.e., is mainly determined from) the position of piston 8 at the compression top dead center. Therefore, the length of piston stroke of piston 8 can be reduced under the low engine load condition, although the engine compression ratio is relatively high. Further, the length of piston stroke of piston 8 can be increased under the high engine load condition, although the engine compression ratio is relatively low.

The above-described variable compression ratio mechanism in this embodiment according to the present invention is suitable for an in-line four-cylinder engine. Generally in the in-line four-cylinder engine, an inertia secondary vibration of piston 8 increases sharply in accordance with the enlargement (of the length) of the piston stroke. Hence, there has been a problem that a noise and vibration characteristic deteriorates and thereby a product quality is significantly impaired if an attempt is made to upsize the engine displacement by the enlargement of the piston stroke. However, the multilink-type piston crank mechanism used in this embodiment has the piston stroke characteristic approximate to (or, close to) simple harmonic motion, and therefore such a deterioration of the noise and vibration characteristic can be avoided.

Moreover, since the multilink-type piston crank mechanism in this embodiment has the piston stroke characteristic close to simple harmonic motion, the speed of piston 8 at the position in proximity to the top dead center is lower than that in the case of the single-link-type piston crank mechanism. Hence, a sufficient time is given to the combustion having same combustion rate (speed) as in the case of the single-link-type piston crank mechanism, and thereby the favorable combustion can be secured even in a combustion chamber having a large displacement per one cylinder.

Furthermore, in this embodiment according to the present invention, a basic multilink is designed and then link dimensions are appropriately set so as to bring the piston stroke characteristic closer to simple harmonic motion, on the supposition that the rotation of control shaft 12 is in a stopped state. Accordingly, the inertia secondary vibration can be minimized even when control shaft 12 is rotating.

In addition, some main configurations and advantages in the above-described embodiment will now be described. In this embodiment as explained above, the internal combustion engine includes a piston reciprocating in a cylinder; a crankshaft; and a multilink piston-crank mechanism (corresponding to piston-crank linking means) linking the piston with the crankshaft. The multilink piston-crank mechanism includes an upper link (corresponding to upper linking means) having a first end connected with the piston by a piston pin; a lower link (corresponding to lower linking means) mounted rotatably on a crankpin of the crankshaft and having a first end connected with a second end of the upper link by a first connection pin; a control link (corresponding to control linking means) having a first end connected with a second end of the lower link by a second connection pin; a control shaft connected movably with a second end of the control link and configured to rotate in synchronization with the crankshaft and at a half rotational speed of the crankshaft; and a phase adjusting section (corresponding to phase adjusting means) configured to variably adjust a phase of rotation of the control shaft relative to the crankshaft in accordance with an operating condition of the engine. Moreover, the multilink piston-crank mechanism is configured to variably control a piston stroke characteristic of the engine. Therefore, since the piston stroke is optimized by such configurations, the remarkable enhancement of the fuel economy and/or output power can be achieved.

This application is based on a prior Japanese Patent Application No. 2004-372466 filed on Dec. 24, 2004. The entire contents of this Japanese Patent Application are hereby incorporated by reference.

Although the invention has been described above with reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An internal combustion engine, comprising:

a piston reciprocating in a cylinder;

a crankshaft; and a multilink piston-crank mechanism linking the piston with the crankshaft and including:

an upper link having a first end connected with the piston by piston pin;

a lower link mounted rotatably on a crankpin of the crankshaft and having a first end connected with a second end of the upper link by a first connection pin;

a control link having a first end connected with a second end of the lower link by a second connection pin;

a control shaft connected movably with a second end of the control link and configured to rotate in synchronization with the crankshaft and at a half rotational speed of the crankshaft; and a phase adjusting section configured to variably adjust a phase of rotation of the control shaft relative to the crankshaft in accordance with an operating condition of the engine, the multilink piston-crank mechanism being configured to variably control a piston stroke characteristic of the engine, wherein the multilink piston-crank mechanism is configured to vary the piston stroke characteristic to allow a compression ratio of the engine in the case where a distance of piston stroke of the piston during an intake stroke is relatively short, to be higher than the compression ratio in the case where the distance of piston stroke of the piston during the intake stroke is relatively long.

2. An internal combustion engine, comprising:

a piston reciprocating in a cylinder;

a crankshaft; and a multilink piston-crank mechanism linking the piston with the crankshaft and including:

an upper link having a first end connected with the piston by a piston pin;

a lower link mounted rotatably on a crankpin of the crankshaft and having a first end connected with a second end of the upper link by a first connection pin;

a control link having a first end connected with a second end of the lower link by a second connection pin;

a control shaft connected movably with a second end of the control link and configured to rotate in synchronization with the crankshaft and at a half rotational speed of the crankshaft; and a phase adjusting section configured to variably adjust a phase of rotation of the control shaft relative to the crankshaft in accordance with an operating condition of the engine, the multilink piston-crank mechanism being configured to variably control a piston stroke characteristic of the engine, wherein the multilink piston-crank mechanism is configured to vary the piston stroke characteristic to allow a volume of a combustion chamber inside the cylinder at an exhaust top dead center of the piston to have a minimum value in the case where a distance of piston stroke of the piston during an intake stroke has a maximum value.

3. An internal combustion engine, comprising:

a piston reciprocating in a cylinder;

a crankshaft; and a multilink piston-crank mechanism linking the piston with the crankshaft and including:

an upper link having a first end connected with the piston by a piston pin;

a lower link mounted rotatably on a crankpin of the crankshaft and having a first end connected with a second end of the upper link by a first connection pin;

a control link having a first end connected with a second end of the lower link by a second connection pin;

a control shaft connected movably with a second end of the control link and configured to rotate in synchronization with the crankshaft and at a half rotational speed of the crankshaft; and a phase adjusting section configured to variably adjust a phase of rotation of the control shaft relative to the crankshaft in accordance with an operating condition of the engine, the multilink piston-crank mechanism being configured to variably control a piston stroke characteristic of the engine, wherein the multilink piston-crank mechanism is configured to vary the piston stroke characteristic to allow a distance of piston stroke of the piston during an expansion stroke to become longer as the distance of piston stroke of the piston during an intake stroke becomes shorter.

4. An internal combustion engine, comprising:

a piston reciprocating in a cylinder;

a crankshaft; and a multilink piston-crank mechanism linking the piston with the crankshaft and including:

an upper link having a first end connected with the piston by a piston pin;

a lower link mounted rotatably on a crankpin of the crankshaft and having a first end connected with a second end of the upper link by a first connection pin;

a control link having a first end connected with a second end of the lower link by a second connection pin;

a control shaft connected movably with a second end of the control link and configured to rotate in synchronization with the crankshaft and a half rotational speed of the crankshaft; and a phase adjusting section configured to variably adjust a phase of rotation of the control shaft relative to the crankshaft in accordance with an operating condition of the engine, the multilink piston-crank being configured to variably control a piston stroke characteristic of the engine, wherein the multilink piston-crank mechanism is configured to vary the piston stroke characteristic to allow a distance of piston stroke of the piston during an intake stroke to be shorter when the operating condition of the engine is under a low load condition, as compared to the distance in the case where the operating condition of the engine is under a high load condition.

5. An internal combustion engine, comprising:

a piston reciprocating in a cylinder;

a crankshaft; and a multilink piston-crank mechanism linking the piston with the crankshaft and including:

an upper link having a first end connected with the piston by a piston pin;

a lower link mounted rotatably on a crankpin of the crankshaft and having a first end connected with a second end of the upper link by a first connection pin;

a control link having a first end connected with a second end of the lower link by a second connection pin;

a control shaft connected movably with a second end of the control link and configured to rotate in synchronization with the crankshaft and at a half rotational speed of the crankshaft; and a phase adjusting section configured to variably adjust a phase of rotation of the control shaft relative to the crankshaft in accordance with an operating condition of the engine, the multilink piston-crank mechanism being configured to variably control a piston stroke characteristic of the engine, wherein the multilink piston-crank mechanism is configured so that the piston stroke characteristic is approximate to simple harmonic motion on the supposition that the rotation of the control shaft is in a stopped state.

6. An internal combustion engine, comprising:

a piston reciprocating in a cylinder;

a crankshaft; and a multilink piston-crank mechanism linking the piston with the crankshaft and including:

an upper link having a first end connected with the piston by a piston pin;

a lower link mounted rotatably on a crankpin of the crankshaft and having a first end connected with a second end of the upper link by a first connection pin;

a control link having a first end connected with a second end of the lower link by a second connection pin;

a control shaft connected movably with a second end of the control link and configured to rotate in synchronization with the crankshaft and at a half rotational speed of the crankshaft; and a phase adjusting section configured to variably adjust a phase of rotation of the control shaft relative to the crankshaft in accordance with an operating condition of the engine, the multilink piston-crank mechanism being configured to variably control a piston stroke characteristic of the engine, wherein the piston pin and the first connection pin have a substantially equal axial distance to each other.

7. An internal combustion engine, comprising:

a piston reciprocating in a cylinder;

a crankshaft; and a multilink piston-crank mechanism linking the piston with the crankshaft and including:

an upper link having a first end connected with the piston by a piston pin;

a lower link mounted rotatably on a crankpin of the crankshaft and having a first end connected with a second end of the upper link by a first connection pin;

a control link having a first end connected with a second end of the lower link by a second connection pin;

a control shaft connected movably with a second end of the control link and configured to rotate in synchronization with the crankshaft and at a half rotational speed of the crankshaft; and a phase adjusting section configured to variably adjust a phase of rotation of the control shaft relative to the crankshaft in accordance with an operating condition of the engine, the multilink piston-crank mechanism being configured to variably control a piston stroke characteristic of the engine, wherein the crankshaft includes a counterweight having an outermost portion which crosses an imaginary extension line extended from the piston pin in an axial direction of the piston pin, when the piston is located in proximity of a bottom dead center.

* * * * *